US009121302B2

(12) United States Patent
Duong et al.

(10) Patent No.: US 9,121,302 B2
(45) Date of Patent: Sep. 1, 2015

(54) RADIAL COMPRESSOR BLADE CLEARANCE CONTROL SYSTEM

(75) Inventors: Loc Quang Duong, San Diego, CA (US); Xiaolan Hu, San Diego, CA (US)

(73) Assignee: Hamilton Sundstrand Corporation, Windsor Locks, CT (US)

( * ) Notice: Subject to any disclaimer, the term of this patent is extended or adjusted under 35 U.S.C. 154(b) by 603 days.

(21) Appl. No.: 13/547,155

(22) Filed: Jul. 12, 2012

(65) Prior Publication Data

US 2014/0017060 A1 Jan. 16, 2014

(51) Int. Cl.
*F01D 11/22* (2006.01)
*F01D 9/04* (2006.01)

(52) U.S. Cl.
CPC ..... *F01D 11/22* (2013.01); *F01D 9/045* (2013.01)

(58) Field of Classification Search
CPC ..... F01D 11/22; F01D 11/20; F01D 11/14; F01D 11/08; F01D 11/00; F01D 9/045
USPC ..... 415/173.3, 174.2, 172.1, 173.2, 174.1
See application file for complete search history.

(56) References Cited

U.S. PATENT DOCUMENTS

| | | | | |
|---|---|---|---|---|
| 3,285,005 | A * | 11/1966 | Harrison | 60/799 |
| 4,264,271 | A * | 4/1981 | Libertini | 415/173.3 |
| 6,273,671 | B1 | 8/2001 | Ress, Jr. | |
| 7,824,151 | B2 | 11/2010 | Schwarz et al. | |
| 2010/0003125 | A1 | 1/2010 | Smith | |
| 2010/0303612 | A1 | 12/2010 | Bhatnagar et al. | |
| 2013/0202428 | A1 | 8/2013 | Renard et al. | |

FOREIGN PATENT DOCUMENTS

WO 2012052687 4/2012

OTHER PUBLICATIONS

International Search Report and Written Opinion, mailed Sep. 27, 2013.

* cited by examiner

*Primary Examiner* — Richard Edgar
(74) *Attorney, Agent, or Firm* — Kinney & Lange, P.A.

(57) ABSTRACT

A diaphragm assembly includes a cylinder, a circular flange, and a diaphragm. The cylinder defines an axis and includes a first end and a second end opposite the first end. The circular flange is coaxial with the cylinder and at a greater radial distance from the axis than the cylinder. The diaphragm extends from the second end of the cylinder to the flange.

20 Claims, 10 Drawing Sheets

RADIAL COMPRESSOR BLADE CLEARANCE CONTROL SYSTEM

BACKGROUND

The present invention relates to gas turbine engines. In particular, the invention relates to adjusting an impeller blade clearance of a radial compressor in a gas turbine engine.

Gas turbine engines generally comprise a compressor and a turbine. Smaller gas turbines often employ a centrifugal or radial compressor, due to its inherent space efficiency. The primary component of a radial compressor is a compressor impeller. The compressor impeller compresses incoming air which is directed through a diffuser to a combustion chamber, mixed with fuel and ignited. The turbine is propelled by rapidly expanding gases resulting from the combustion of the fuel and the compressed incoming air. The compressor impeller is linked to, and powered by, the turbine.

Overall gas turbine engine efficiency is determined in part by a compression ratio (air pressure exiting the compressor divided by the air pressure entering the compressor). The higher the compression ratio, the higher the gas turbine engine efficiency. The compression ratio is a function of the efficiency of the compressor. The efficiency of a radial compressor is strongly associated with a radial clearance between blade tips of a compressor impeller and a compressor shroud radially surrounding the compressor impeller. As engine and environmental conditions change over the operating range of the engine, this radial clearance varies from a relatively large clearance to no clearance at all. Under conditions resulting in a relatively large clearance, air leaks past the blade tips resulting in a reduction of the compression ratio and a loss of compressor efficiency. Under conditions leading to no clearance at all, the blade tips may rub against the compressor shroud. Such blade rubbing not only reduces compressor efficiency, but may also damage the compressor impeller. Thus, compressor efficiency, and ultimately gas turbine engine efficiency relies in part on maintaining a relatively small radial clearance between blade tips of the compressor impeller and the compressor shroud, while ensuring the radial clearance is sufficient to prevent blade rubbing.

SUMMARY

A diaphragm assembly includes a cylinder, a circular flange, and a diaphragm. The cylinder defines an axis and includes a first end and a second end opposite the first end. The circular flange is coaxial with the cylinder and at a greater radial distance from the axis than the cylinder. The diaphragm extends from the second end of the cylinder to the flange.

DETAILED DESCRIPTION

Generally, conventional radial compressors in gas turbine engines lack a mechanism for maintaining a relatively small radial clearance between blade tips of a compressor impeller and a compressor shroud, while ensuring the radial clearance is sufficient to prevent blade rubbing. Those radial compressors that do have such an adjustment mechanism typically rely on a system of gears and threads to move the shroud. While such systems are effective, they do suffer from performance issues related to the use of gears, such as gear pitch diameter run-out, tooth spacing error, and tooth backlash, including tooth backlash variation under different operational conditions.

Radial compressors of the present invention include a novel compressor shroud adjustment mechanism that employs a diaphragm assembly incorporating a diaphragm that flexes within its elastic range to move the compressor shroud. The diaphragm is coaxial with the shroud and radially outward from at least a portion of the shroud. An actuator moves a portion of the diaphragm assembly connected to the shroud and the shroud in an axial direction, deflecting the diaphragm. In the elastic operating range, a linear relationship exists between the extent of diaphragm deflection and the force applied by the actuator to cause the diaphragm deflection. The diaphragm strain energy provides a restoring force. When the force applied by the actuator is reduced, the restoring force of the strained diaphragm moves the portion of the diaphragm assembly connected to the shroud and the shroud in an opposite axial direction. Thus the actuator moves a portion of the diaphragm assembly and the shroud in an axial direction against a restoring force of the diaphragm. The force applied by the actuator and the degree of deflection of the diaphragm combine to move the shroud to a desired position to maintain a relatively small radial clearance between the impeller blade tips and the shroud, while ensuring the radial clearance is sufficient to prevent blade rubbing. In addition, the use of the diaphragm assembly eliminates the need for gears, thus eliminating the performance issues related to the use of gears.

Figure 1:
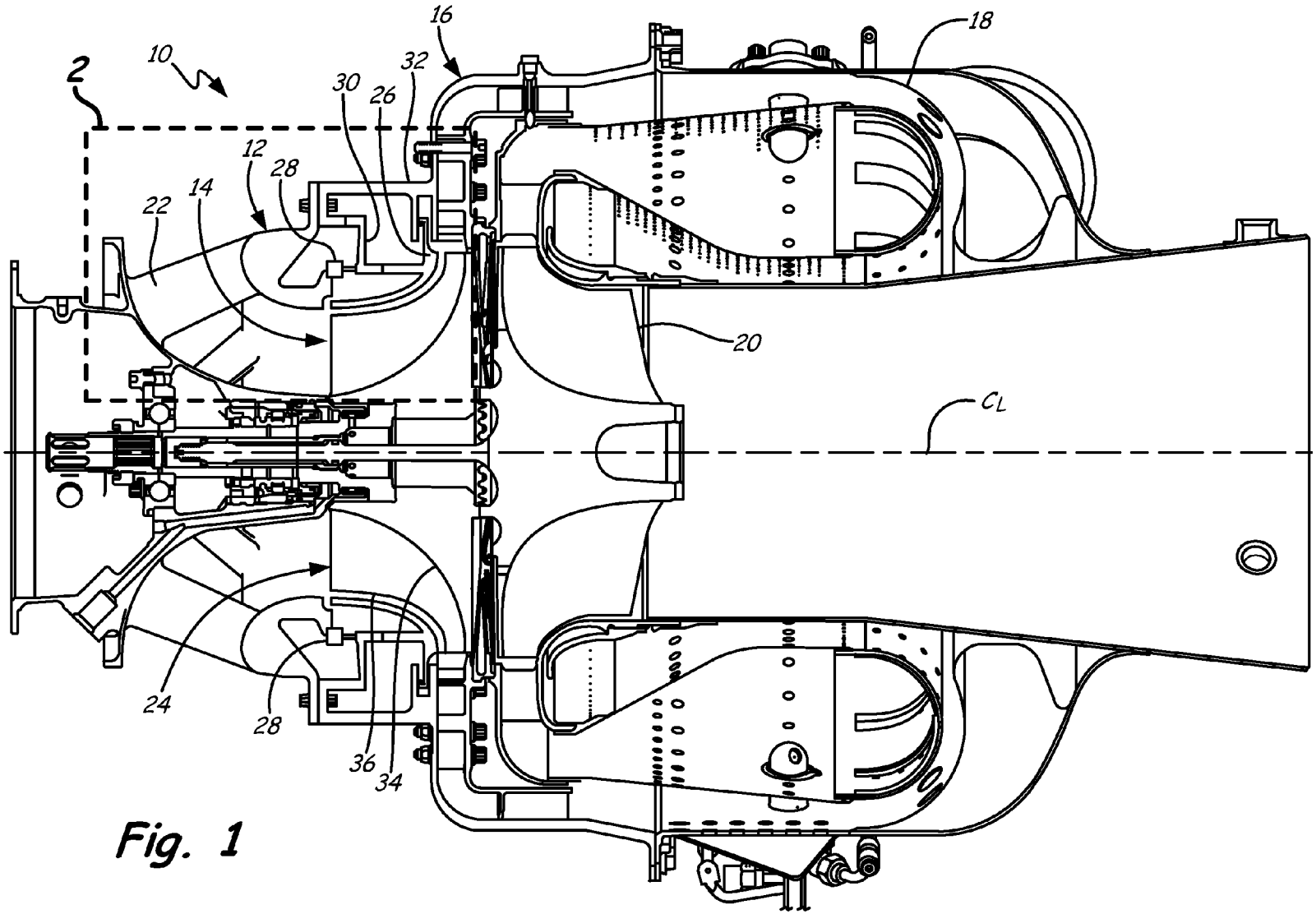
FIG. 1 is a side cross-sectional view of a gas turbine engine embodying the present invention.

FIG. 1 is a side cross-sectional view of a gas turbine engine embodying the present invention. FIG. 1 shows gas turbine engine 10 including air inlet structure 12, radial compressor 14, diffuser 16, combustor 18, and turbine 20. Air inlet structure 12 defines air inlet 22. Radial compressor 14 includes impeller 24, compressor shroud 26, actuators 28, and diaphragm assembly 30. Diffuser 16 includes diffuser case 32. Impeller 24 is generally frustoconical and includes hub 34 and impeller blades 36. Hub 34 is generally frustoconical in shape. Impeller blades 36 are coupled to and extend radially from hub 34. Actuators 28 as shown are two separate actuators disposed about 180 degrees around the circumference of diaphragm assembly 30 from each other. Actuators 28 may be of any type of actuator known in the art, including, for example, hydraulic actuators, pneumatic actuators, and electromagnetic actuators. Turbine 20 is illustrated as a radial inflow turbine, however it is understood that the present invention can be used with axial turbine rotor, including, for example, integrated bladed rotors.

Air inlet structure 12 attaches to diffuser case 32 of diffuser 16 such that radial compressor 14 is between, and in fluid communication with, air inlet structure 12 and diffuser 16. Combustor 18 is connected to diffuser 16 and opposite radial compressor 14. Combustor 18 radially surrounds turbine 20. Turbine 20 is connected to compressor impeller 24 on a shaft such that compressor impeller 24 and turbine 20 rotate together around axis $C_L$. Compressor shroud 26 is generally frustoconical in shape and coaxial with compressor impeller 24 such that it axially surrounds compressor impeller 24, forming a gap between impeller blades 36 and compressor shroud 26. Diaphragm assembly 30 is connected to compressor shroud 26 and to air inlet housing 12. Diaphragm assembly 30 is coaxial with compressor shroud 26, and thus, with compressor impeller 24. Compressor shroud 26 is also connected to diffuser case 32 as discussed below in reference to FIG. 2. Actuators 28 are attached to air inlet structure 12 and are connected to diaphragm assembly 30.

In operation, air enters air inlet 22 of air inlet structure 12 and flows to compressor 14 where it is compressed by the centrifugal action of rotating impeller blades 36 and hub 34. Impeller blades 36, hub 34, and shroud 26 form a flow path through compressor 14, directing the compressed air to diffuser 16. Diffuser 16 comprises a series of impediments to air flow, such as angled vanes, to slow the compressed air, and increase its pressure. The compressed air then flows into combustor 18 where it mixes with fuel and is ignited to produce a flame in combustor chamber 18. High temperature gases produced by the flame expand rapidly and propel turbine 20. Turbine 20 drives compressor impeller 24 by way of a coupling between turbine 20 and compressor impeller 24.

Compressor efficiency, and ultimately gas turbine engine efficiency, relies in part on controlling the gap formed between impeller blades 36 and compressor shroud 26. In use, the gap changes as a function of temperature changes and gas loading of compressor 14. These factors affect both compressor shroud 26 and impeller blades 36. However, under load, impeller blades 36 also deform due to a radial displacement resulting from centrifugal loading of the blades. There is no analogous effect on compressor shroud 26 because it does not rotate. Thus, the centrifugal loading has the largest effect on the gap between impeller blades 36 and compressor shroud 26. The embodiment of FIG. 1 changes the gap between impeller blades 36 and compressor shroud 26 by commanding actuators 28 to apply a force to diaphragm assembly 30 in an axial direction. A portion of diaphragm assembly 30 connected to compressor shroud 26 moves in the axial direction, moving compressor shroud 26 relative to impeller blades 36 to change the gap. A portion of diaphragm assembly 30 deflects during this movement, developing a restoring force such that when the force applied by actuators 28 is then reduced, the restoring force acts to move compressor shroud 26 in an axial direction opposite that produced by the action of actuators 28, again changing the gap. The force applied by actuators 28 and the restoring force of diaphragm assembly 30 combine to move compressor shroud 26 to a desired position to maintain a relatively small radial clearance between the tips of impeller blades 36 and compressor shroud 26, while ensuring the radial clearance is sufficient to prevent blade rubbing. The use of diaphragm assembly 30 eliminates the need for gears, thus eliminating the performance issues related to the use of gears.

A method for dynamically controlling the distance, or gap, between the tips of impeller blades 36 and compressor shroud 26 is accomplished by measuring a temperature of fluid as it flows into compressor impeller 24, measuring a pressure of fluid exiting compressor impeller 24, and measuring rotation rate of compressor impeller 24. These measurements are then employed to determine a desired distance, or gap, between impeller blades 36 and compressor shroud 26 for conditions represented by these measurements. Actuators 28 are then commanded to apply a force to move diaphragm assembly 30 such that the combination of the force applied by actuators 28 and a restoring force of diaphragm assembly 30 move attached compressor shroud 26 to an axial position corresponding to the desired distance, or gap. Once the axial position is reached, the above described method is repeated, providing feedback control of the gap between the tips of impeller blades 36 and compressor shroud 26.

Figure 2:
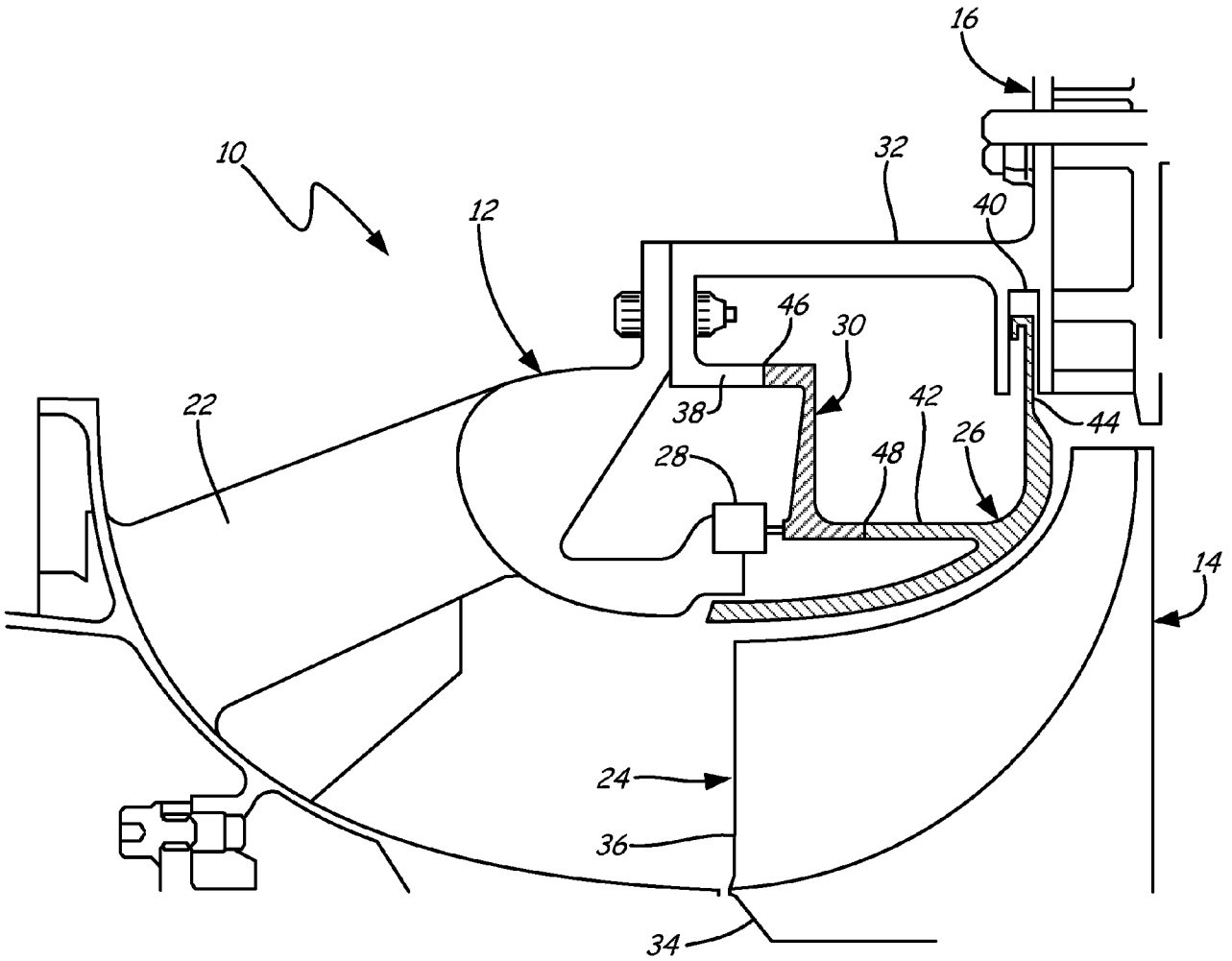
FIG. 2 is an enlarged cross-section view of a portion of the radial compressor of the gas turbine engine of FIG. 1.

FIG. 2 is an enlarged cross-section view of a portion of the radial compressor of gas turbine engine 10 of FIG. 1. FIG. 2 illustrates that diffuser case 32 includes flange portion 38 and shroud slot 40. Flange portion 38 is an axially facing extension of diffuser case 32. Shroud slot 40 is an opening in diffuser case 32 extending circumferentially around compressor shroud 26. As also shown in FIG. 2, compressor shroud 26 includes axial extension 42 and spring hook 44. Axial extension 42 is a cylindrical structure that extends from a side of compressor shroud 26 opposite impeller blades 36 and faces in an axial direction opposite flange portion 38. Axial extension 42 may be formed with compressor shroud 26 or may be welded to compressor shroud. Axial extension may also include lightening holes to reduce weight. Spring hook 44 extends from compressor shroud 26 in a generally radial direction.

Diaphragm assembly 30 attaches to flange portion 38 at weld 46 and also attaches to axial extension 42 of compressor shroud 26 at weld 48. Spring hook 44 fits into shroud slot 40 to connect compressor shroud 26 to diffuser case 32.

Operation is as described above in reference to FIG. 1 and FIG. 2, with actuators 28 applying a force to diaphragm assembly 30 in an axial direction. A portion of diaphragm assembly 30 connected to flange portion 38 at weld 46 remains relatively static while another portion of diaphragm assembly 30 connected to axial extension 42 at weld 48 moves in the axial direction, moving compressor shroud 26 relative to impeller blades 36 to change the gap. A portion of diaphragm assembly 30 deflects during this movement, developing a restoring force such that when the force applied by actuators 28 is then reduced, the restoring force acts to move attached compressor shroud 26 in an axial direction opposite that produced by the action of actuators 28, again changing the gap. Spring hook 44 permits a radially outward extending edge of compressor shroud 26 to flex slightly while preventing the radially outward extending edge from extending too far in an axial direction. Spring hook 44 also slides radially within shroud slot 40 to accommodate changes in operating conditions, for example, temperature and pressure. Shroud slot 40 may be provided with a wear resistant coating to extend the life of diffuser case 32.

Figure 3:
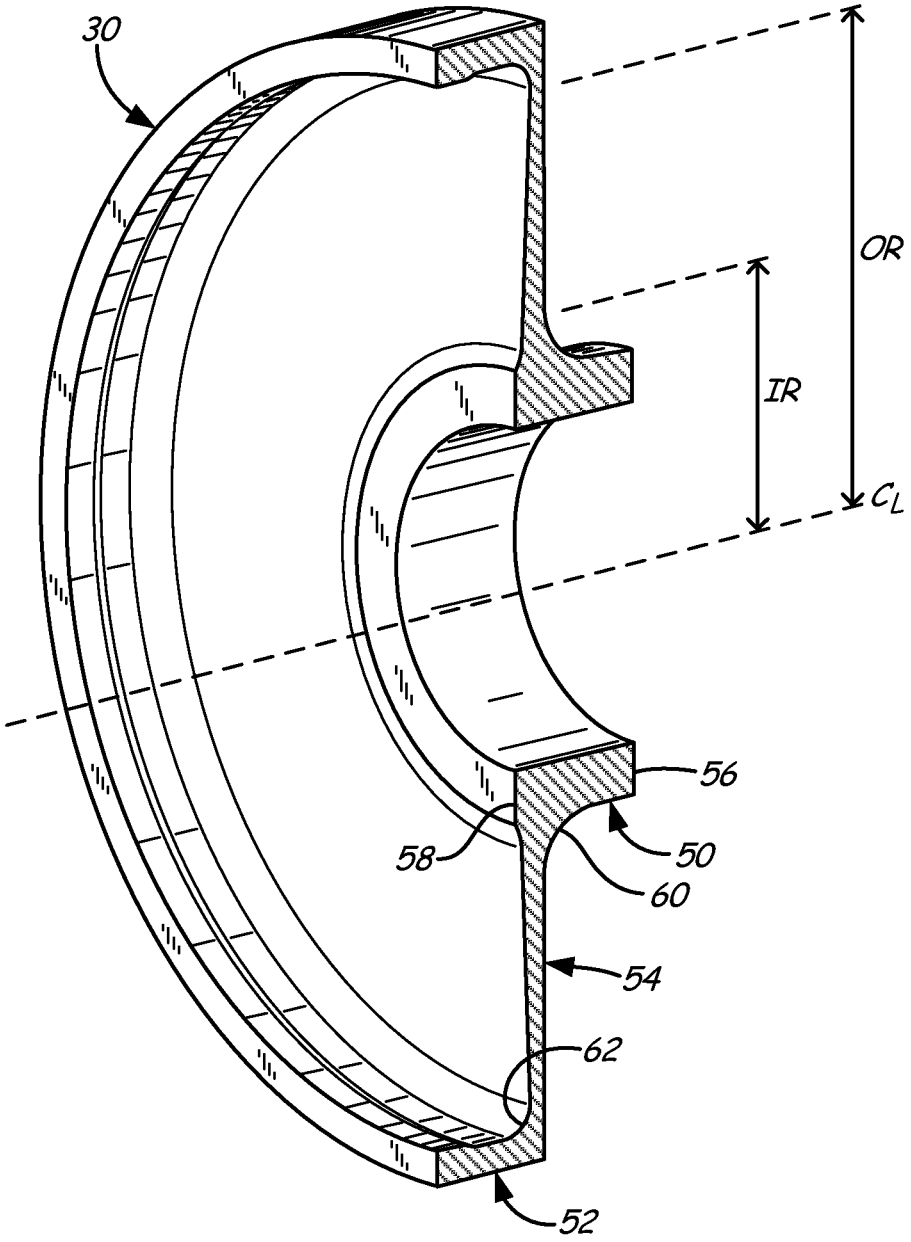
FIG. 3 is a cross-sectional perspective view of the diaphragm assembly of FIG. 2.

FIG. 3 is a cross-sectional perspective view of the diaphragm assembly of FIG. 2. As shown in FIG. 3, diaphragm assembly 30 includes cylinder 50, circular flange 52, and diaphragm 54. As with any cylinder, cylinder 50 defines an axis, which in this embodiment, is also axis $C_L$ because diaphragm assembly 30 is coaxial with compressor impeller 24, as noted above in reference to FIG. 1. Cylinder 50 includes first end 56 and second end 58 opposite first end 56. Circular flange 52 is coaxial with cylinder 50 and at a greater radial distance from axis $C_L$ than cylinder 50. Circular flange 52 includes a radial outer-most surface that is substantially cylindrical in shape. Diaphragm 54 extends from second end 58 of cylinder 50 to circular flange 52. In this embodiment, circular flange 52 extends in an axial direction away from first end 56.

The embodiment of FIG. 3 also includes inner fillet 60 and outer fillet 62. Inner fillet 60 is disposed where diaphragm 54 extends from second end 58 on a side of diaphragm 54 facing first end 56. Outer fillet 62 is disposed where diaphragm 54 extends to circular flange 52 on a side of diaphragm 54 facing away from first end 56.

Considering FIGS. 2 and 3 together, diaphragm assembly 30 is attached at outer flange 52 to flange portion 38 by weld 46. Similarly, diaphragm assembly 30 is attached at first end 56 of cylinder 50 to axial extension 42 by weld 48. Actuators 28 apply a force to diaphragm assembly 30 in an axial direction at second end 58 of cylinder 50.

Figure 4:
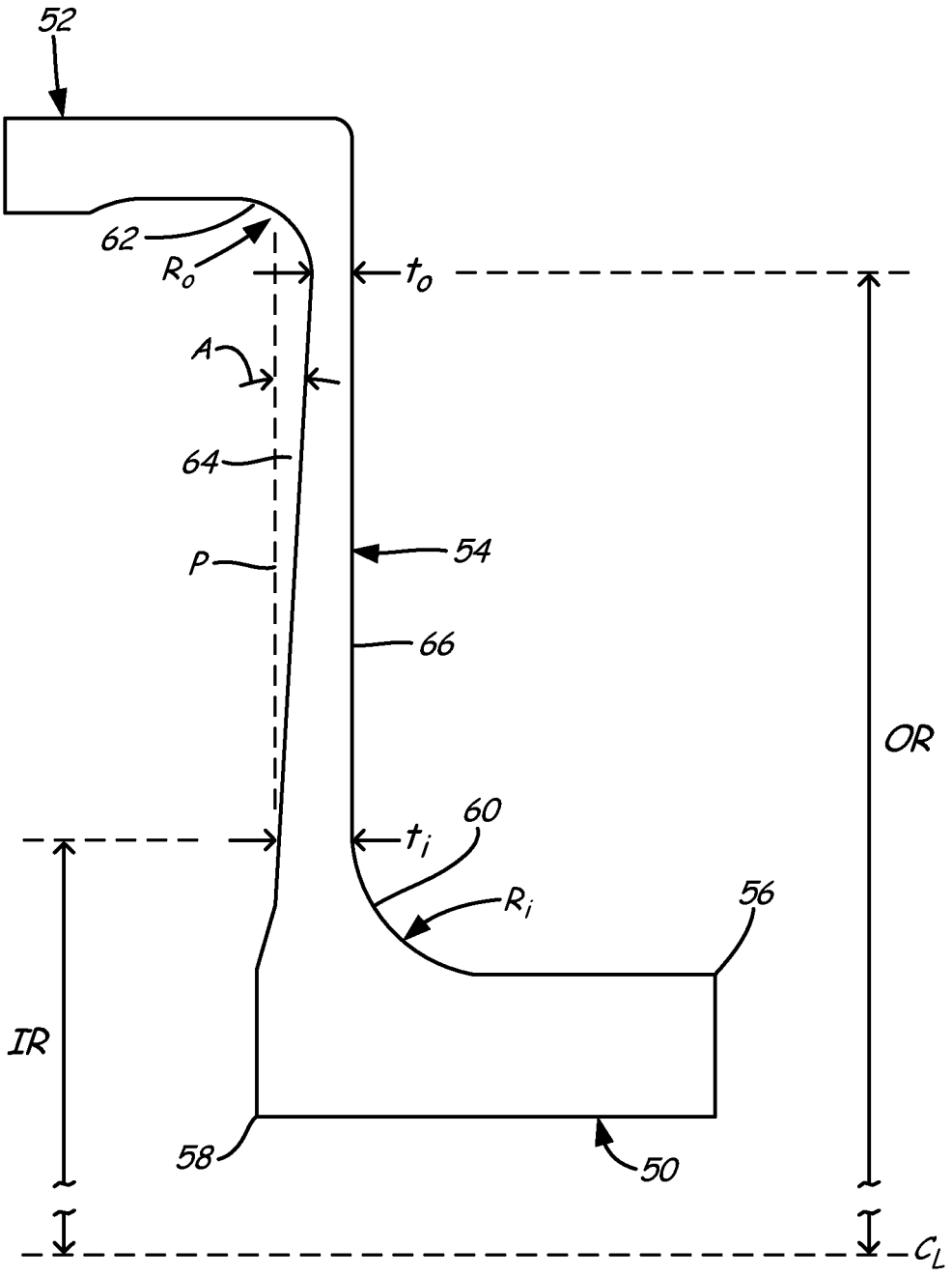
FIG. 4 is a cross-section view of a portion of the diaphragm assembly of FIG. 3.

FIG. 4 is a cross-section view of a portion of diaphragm assembly 30 of FIG. 3. FIG. 4 shows additional details of the shape of diaphragm 54, inner fillet 60, and outer fillet 62. As shown in FIG. 4, diaphragm 54 includes first side 64 and second side 66. First side 64 faces away from first end 56 and forms angle A with respect to plane P, plane P being any plane perpendicular to axis $C_L$. Angle A is such that diaphragm 54 tapers in a radially outward direction. Angle A may be, for example, as much as 15 degrees. In contrast, second side 66 faces toward first end 56 and is perpendicular to axis $C_L$, and thus parallel to plane P.

Figure 5:
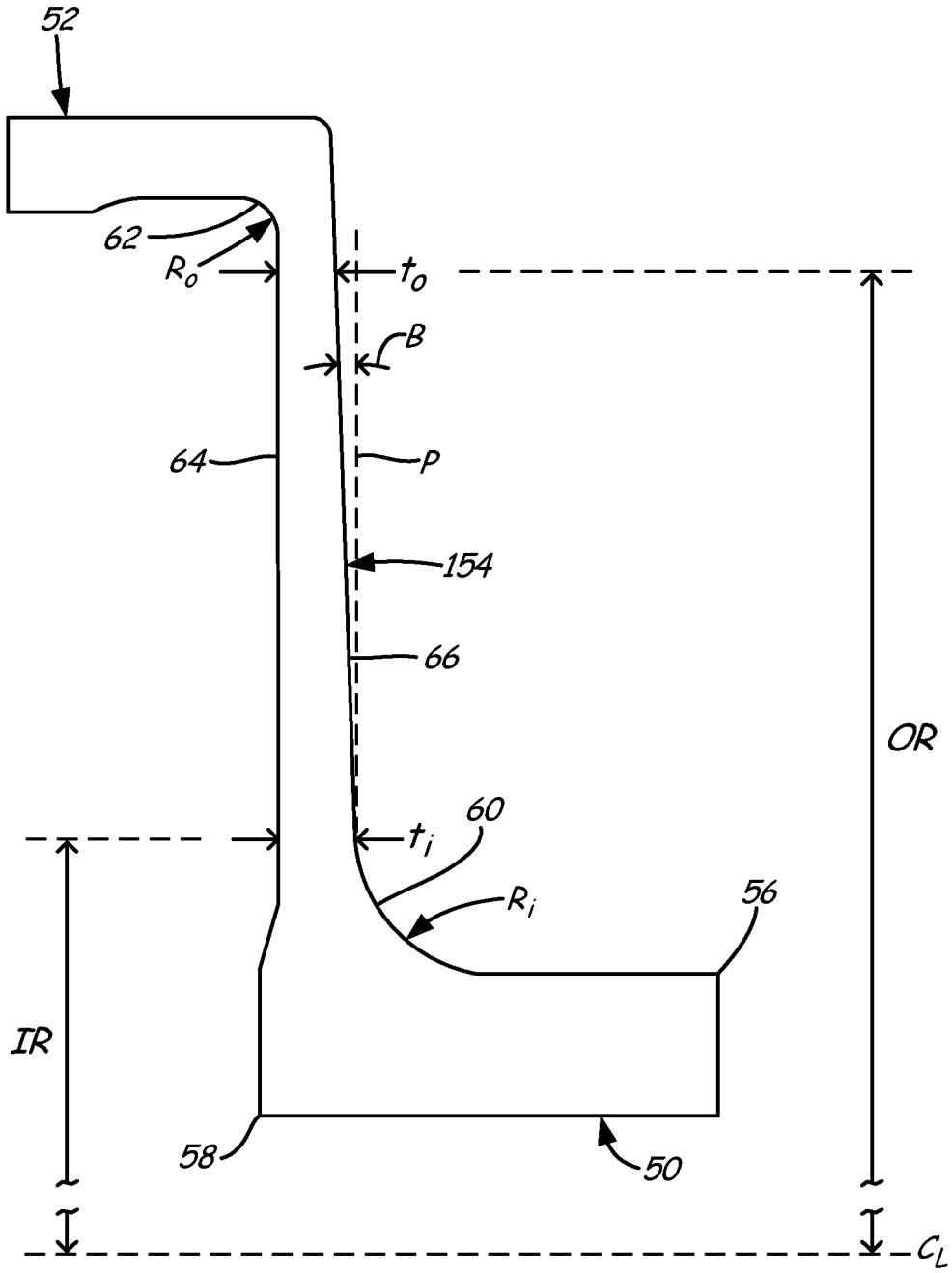
FIG. 5 is a cross-section view of a portion of an alternative diaphragm assembly.

FIG. 5 is a cross-section view of a portion of alternative diaphragm 154. In diaphragm 154 as shown in FIG. 5, first side 64 is perpendicular to axis $C_L$ (Angle A is 0 degrees), and thus parallel to plane P, while second side 66 forms angle B with respect to plane P. Angle B is such that diaphragm 154 tapers in a radially outward direction. Angle B may be, for example, as much as 15 degrees.

Figure 6:
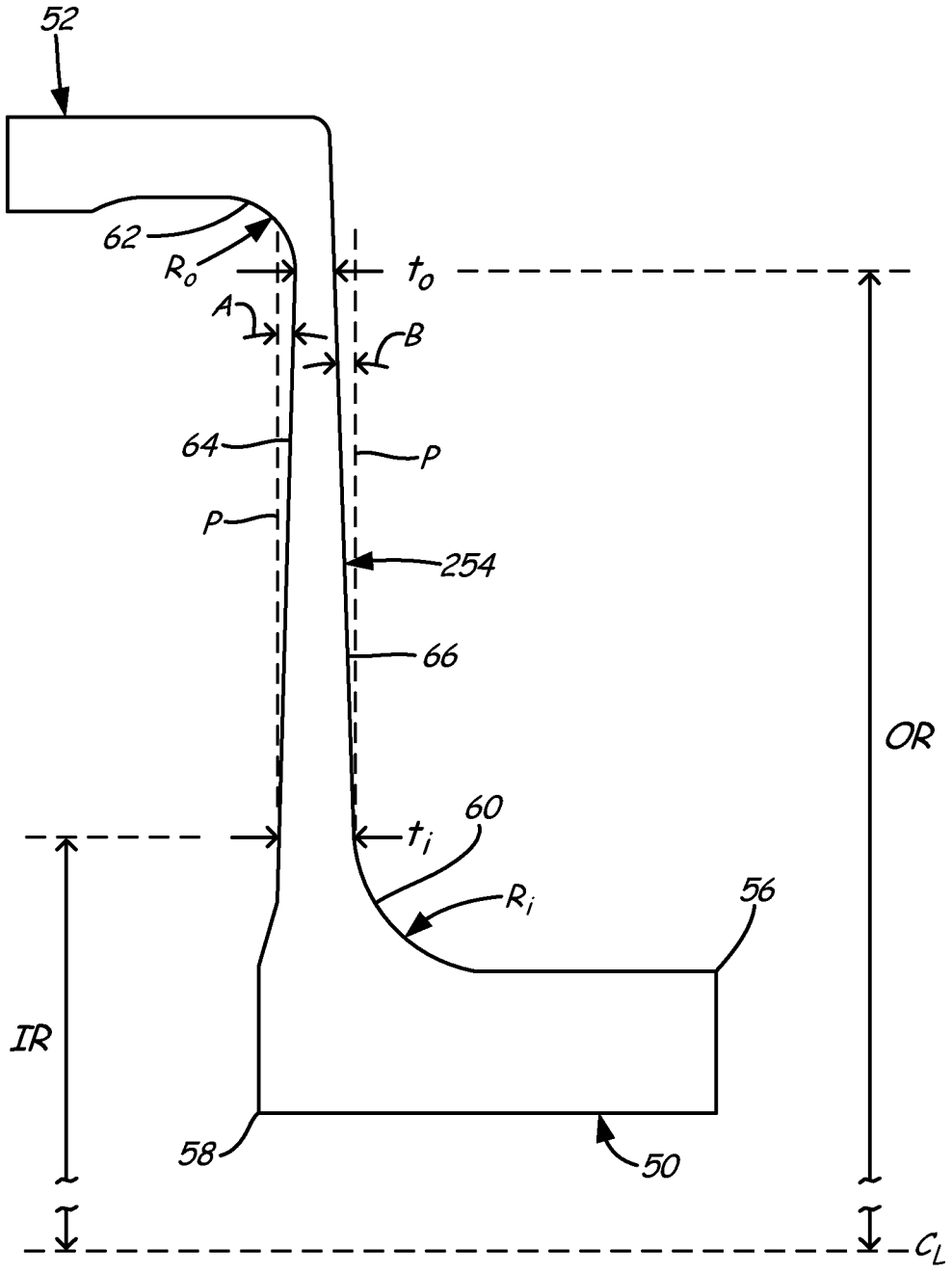
FIG. 6 is a cross-section view of a portion of another alternative diaphragm assembly.

FIG. 6 is a cross-section view of a portion of another alternative diaphragm 254. In diaphragm 254 as shown in FIG. 6, first side 64 forms angle A with respect to plane P and second side 66 forms angle B with respect to plane P. Angle A and angle B are such that each results in diaphragm 254 tapering in a radially outward direction. Angle A and angle B may be, for example, as much as 15 degrees. In still other embodiments, angle A and angle B may each be between 0 degrees and 15 degrees.

Diaphragm assembly 30 may be further described by reference to dimensions shown in FIG. 4. Diaphragm assembly 30 has inner radius IR and outer radius OR. Inner radius IR is a radial distance from axis $C_L$ to a maximum radial extent of inner fillet 60. Outer radius OR is a radial distance from axis $C_L$ to a minimum radial extent of outer fillet 62. Diaphragm assembly 30 may have a ratio of outer radius OR to inner radius IR of no less than 1.4 and no greater than 1.8. Diaphragm 54 tapers in thickness from inner radius thickness $t_i$ at inner radius IR to and outer radius thickness $t_o$ at outer radius OR, where inner radius thickness $t_i$ is greater than outer radius thickness $t_o$. Diaphragm 54 may have a ratio of inner radius thickness $t_i$ to outer radius thickness $t_o$ of no less than 2 and no greater than 4. Inner fillet 60 and outer fillet 62 may be further described by their respective radii of curvature. Diaphragm assembly 30 may have a ratio of a radius of curvature of inner fillet 60 to inner radius thickness $t_i$ of no less than 3 and no greater than 6. In addition, diaphragm assembly 30 may have a have a ratio of a radius of curvature of outer fillet 62 to outer radius thickness $t_o$ of no less than 4 and no greater than 8.

Figure 7:
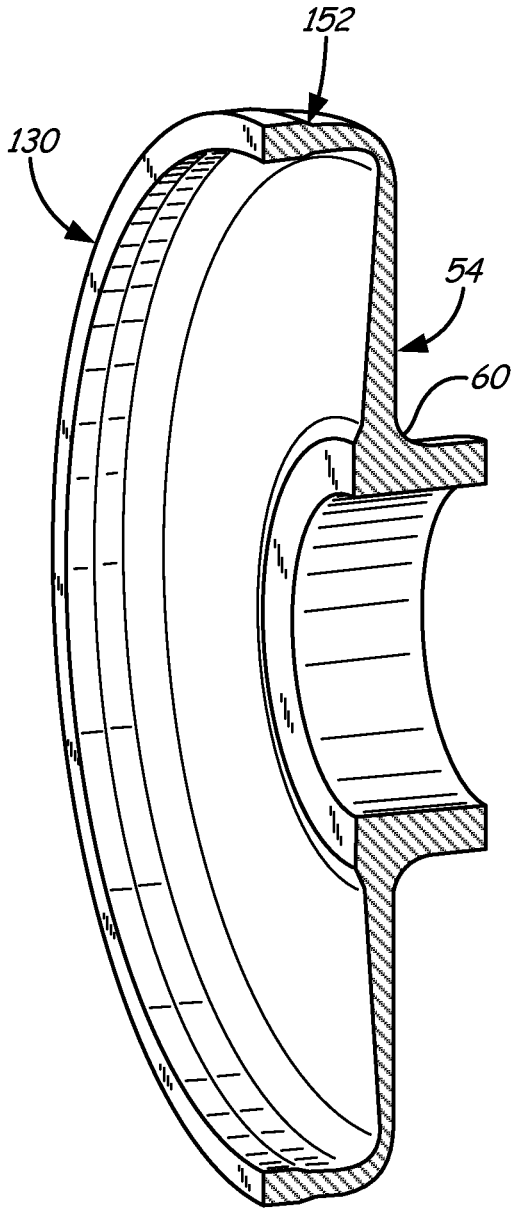
FIG. 7 is a cross-sectional perspective view of an alternative diaphragm assembly.

FIG. 7 is a cross-sectional perspective view of an alternative diaphragm assembly. Diaphragm assembly 130 is identical to diaphragm assembly 30 described above, except that circular flange 152 replaces circular flange 52. Unlike circular flange 52 with a radial outer-most surface that is substantially cylindrical in shape, circular flange 152 includes a radial outer-most surface that is radially contoured in the axial direction.

Figure 8:
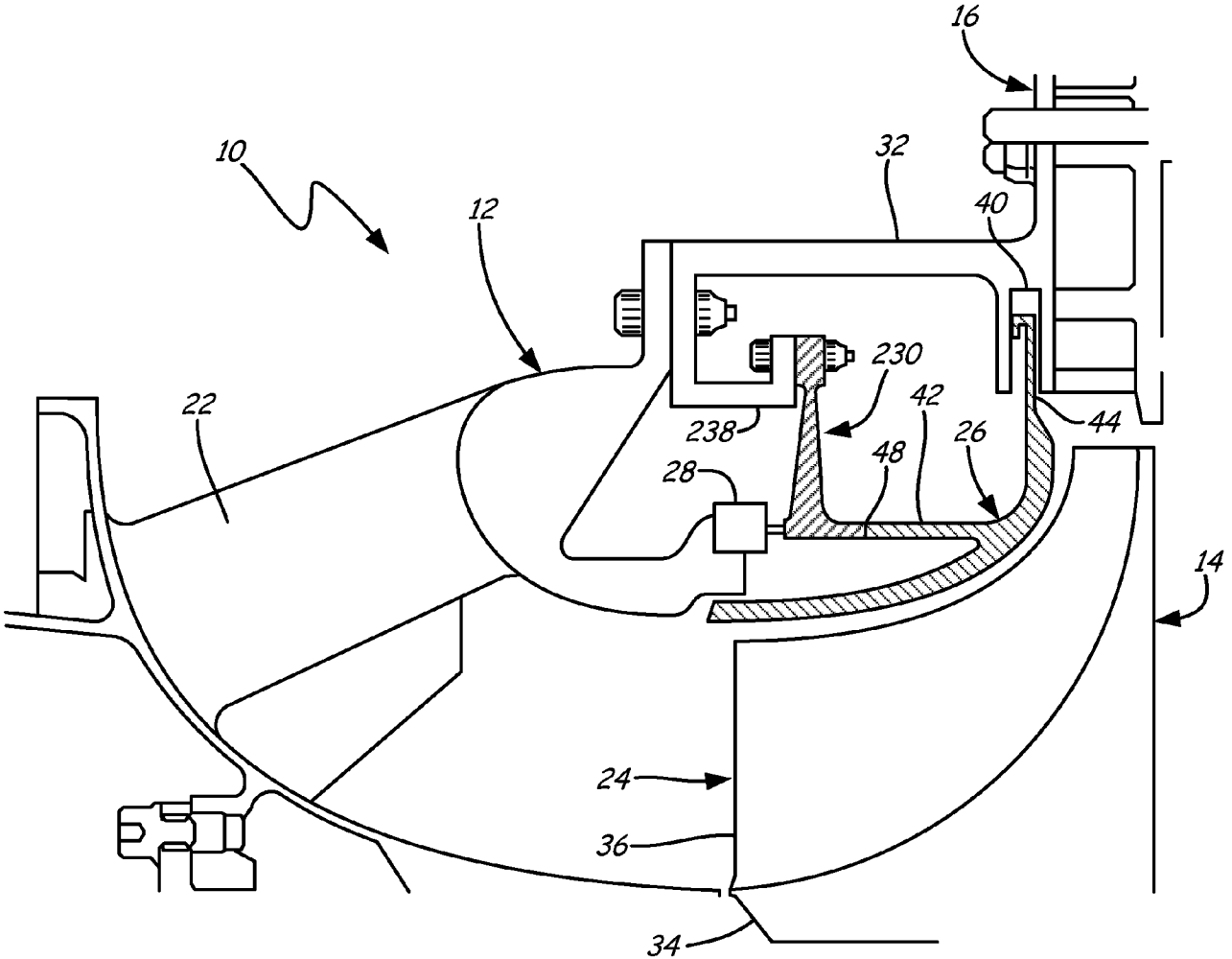
FIG. 8 is an enlarged cross-section view of a portion of the radial compressor of the gas turbine engine of FIG. 1 including an alternative diaphragm assembly.

FIG. 8 is an enlarged cross-section view of a portion of the radial compressor of the gas turbine engine of FIG. 1 including an alternative diaphragm assembly. In the embodiment illustrated in FIG. 8 the diaphragm assembly connects to the flange portion of the diffuser case by a bolted connection instead of a welded connection. FIG. 8 is identical to FIG. 2 described above except that diffuser case 32 includes flange portion 238, instead of flange portion 38; and diaphragm assembly 230 replaces diaphragm assembly 30. Flange portion 238 includes a series of bolt holes (not shown) disposed circumferentially around axis $C_L$. Diaphragm assembly 230 includes a radially extending flange including a series of bolt holes as described below in reference to FIG. 9. In the embodiment of FIG. 8, diaphragm assembly 230 attaches to flange portion 238 of diffuser case 32. As with diaphragm assembly 30 described above in reference to FIG. 2, diaphragm assembly 230 also attaches to axial extension 42 of compressor shroud 26 at weld 48.

Operation is as described above in reference to FIGS. 1 and 2, with the portion of diaphragm assembly 230 connected to flange portion 238 remaining relatively static while the portion of diaphragm assembly 230 connected to axial extension 42 at weld 48 moves in the axial direction, moving compressor shroud 26 relative to impeller blades 26 to change the gap. By replacing a welded connection with a bolted connection, the embodiment of FIG. 8 permits more convenient installation and servicing of compressor shroud 26 and diaphragm assembly 230.

Figure 9:
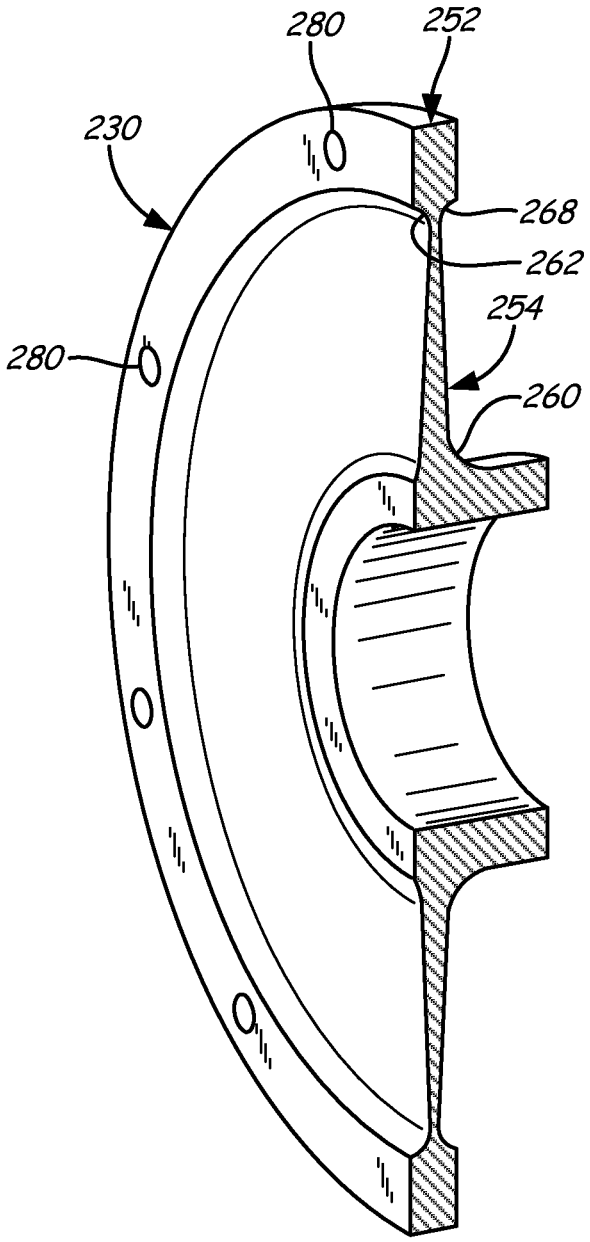
FIG. 9 is a cross-section perspective view of the alternative diaphragm assembly of FIG. 8.

FIG. 9 is a cross-section perspective view of the alternative diaphragm assembly shown in FIG. 8. Diaphragm assembly 230 is identical to diaphragm assembly 30, except that radially extending flange 252 replaces circular flange 52 and diaphragm 254 replaces diaphragm 54. Radially extending flange 252 includes a series of bolt holes 280 disposed circumferentially around axis $C_L$ such that, when properly aligned, the bolt holes of flange portion 238 and bolt holes 280 align. In the embodiment of FIG. 9, diaphragm 254 has a symmetrical cross-section with respect to a plane perpendicular to axis $C_L$ such that both sides of diaphragm 254 form equal but opposite taper angles from a plane perpendicular to the axis of no less than 0 degrees and no greater than 15 degrees. Thus, in diaphragm assembly 230, first outer fillet 262 replaces outer fillet 62, inner fillet 260 replaces inner fillet 60, and diaphragm assembly 230 further includes second outer fillet 268 which is symmetrical to first outer fillet 262.

Figure 10A:
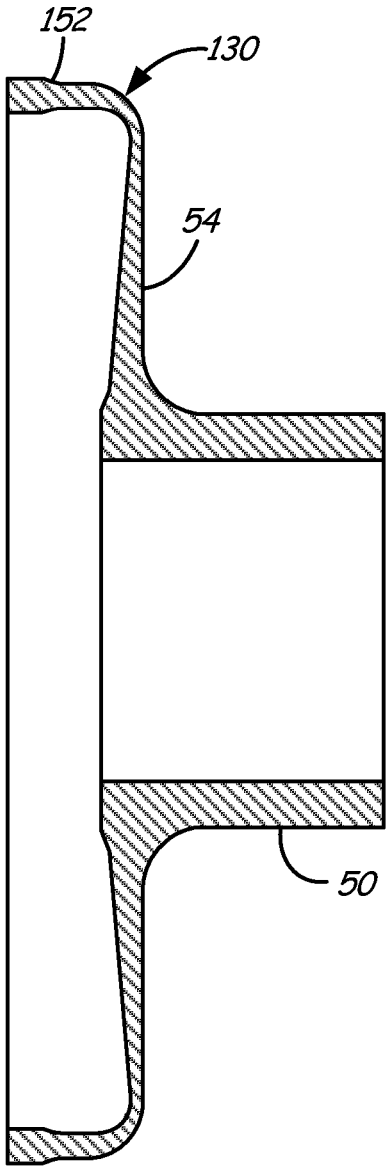
FIGS. 10A and 10B illustrate the operation of the diaphragm assembly shown in FIG. 7.
Figure 10B:
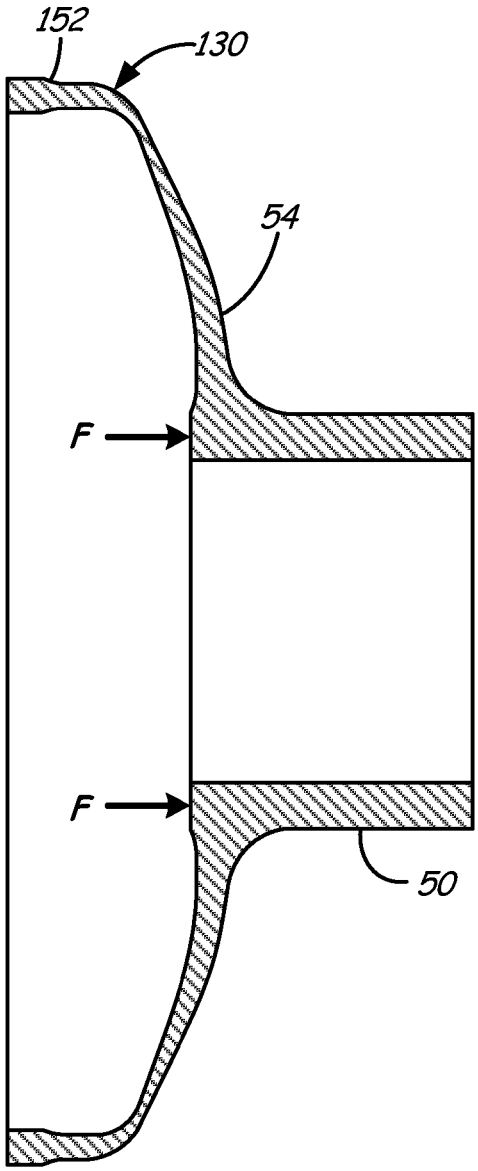

FIGS. 10A and 10B illustrate the operation of a diaphragm assembly, such as diaphragm assembly 130 shown in FIG. 7. Considering FIG. 10A shows diaphragm assembly 130 in a fully non-strained state, as would be the case with no force applied by actuators 28. FIG. 10B shows diaphragm assembly 130 in a strained state with force F applied by actuators 28. Thus, force F applied to diaphragm assembly 130 at cylinder 50 causes cylinder 50 (and attached compressor shroud 26) to move in an axial direction.

The embodiment of FIGS. 1, 2, and 3 taken together shows actuators 28 disposed about 180 degrees around the circumference of cylinder 50 from each other. However, it is understood that the present invention encompasses embodiments having only a single actuator as well as embodiments having more than two actuators. In embodiments including more than two actuators, the plurality of actuators are disposed substantially evenly around the circumference of cylinder 50. Substantially evenly being an even distribution to within generally accepted manufacturing tolerances as would be understood by those skilled in the art.

Diaphragm assemblies described above include various combinations of first sides and second sides angled from 0 degrees up to and including 15 degrees with respect to a plane perpendicular to axis $C_L$ so as to produce a tapering of the diaphragm in a radial direction. It is understood that the present invention encompasses additional embodiments having combinations of first sides and second sides so angled to produce a tapering of the diaphragm.

Embodiments described above include a novel compressor shroud adjustment mechanism that employs a diaphragm assembly incorporating a diaphragm that flexes within its elastic range to move the compressor shroud. An actuator moves a portion of the diaphragm assembly and the shroud in an axial direction against a restoring force of the diaphragm. The force applied by the actuator and the degree of deflection of the diaphragm combine to move the shroud to a desired position to maintain a relatively small radial clearance between the impeller blade tips and the shroud, while ensuring the radial clearance is sufficient to prevent blade rubbing. The use of the diaphragm assembly eliminates the need for gears, thus eliminating the performance issues related to the use of gears.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

DISCUSSION OF POSSIBLE EMBODIMENTS

The following are non-exclusive descriptions of possible embodiments of the present invention.

A diaphragm assembly includes a cylinder defining an axis, the cylinder including a first end; and a second end opposite the first end; a circular flange coaxial with the cylinder and at a greater radial distance from the axis than the cylinder; and a diaphragm extending from the second end of the cylinder to the flange.

The diaphragm assembly of the preceding paragraph can optionally include, additionally and/or alternatively, any one or more of the following features, configurations and/or additional components:

an inner fillet where the diaphragm extends from the second end of the cylinder, the inner fillet on a side of the diaphragm facing the first end of the cylinder; and an outer fillet where the diaphragm extends to the flange, the outer fillet on a side of the diaphragm facing away from the first end of the cylinder;

an inner radius at a maximum radial extent of the inner fillet and an outer radius at a minimum radial extent of the outer fillet; a ratio of the outer radius to the inner radius is no less than 1.4 and no greater than 1.8;

wherein the diaphragm tapers in thickness from an inner radius thickness at a maximum radial extent of the inner fillet to an outer radius thickness at a minimum radial extent of the outer fillet; the inner radius thickness being greater than the outer radius thickness;

wherein a ratio of the inner radius thickness to the outer radius thickness is no less than 2 and no greater than 4;

wherein a ratio of a radius of curvature of the inner fillet to the inner radius thickness is no less than 3 and no greater than 6; and a ratio of curvature of the outer fillet to the outer radius thickness is no less than 4 and no greater than 8;

wherein the side of the diaphragm facing away from the first end of the cylinder forms a taper angle from a plane perpendicular to the axis of no less than 0 degrees and no greater than 15 degrees; and wherein the side of the diaphragm facing the first end of the cylinder forms a taper angle from a plane perpendicular to the axis of no less than 0 degrees and no greater than 15 degrees.

A radial compressor includes an impeller rotatable about an axis, the impeller including a frustoconical hub and a plurality of impeller blades extending radially from the hub; a frustoconical shroud coaxial with the impeller and spaced a distance from the impeller blades to form a fluid flow path between the hub and the shroud; a diaphragm assembly; and a first actuator; the diaphragm assembly includes a cylinder coaxial with and radially outward from a portion of the shroud, the cylinder having a first end connected to the shroud and a second end opposite the first end; a circular flange coaxial with the cylinder and at a greater radial distance from the axis than the cylinder; and a diaphragm extending from the second end of the cylinder to the flange; the first actuator is connected to the second end of the cylinder to move the cylinder and shroud in an axial direction against a restoring force of the diaphragm and change the distance between the shroud and the impeller blades.

The radial compressor of the preceding paragraph can optionally include, additionally and/or alternatively, any one or more of the following features, configurations and/or additional components:

wherein the diaphragm assembly further includes an inner fillet where the diaphragm extends from the second end of the cylinder, the inner fillet on a side of the diaphragm facing the first end of the cylinder; and an outer fillet where the diaphragm extends to the outer flange, the outer fillet on a side of the diaphragm facing away from the first end of the cylinder;

wherein the diaphragm tapers in thickness from an inner radius thickness at a maximum radial extent of the inner fillet to an outer radius thickness at a minimum radial extent of the outer fillet; the inner radius thickness being greater than the outer radius thickness;

a ratio of the inner radius thickness to the outer radius thickness is no less than 2 and no greater than 4;

wherein a ratio of a radius of curvature of the inner fillet to the inner radius thickness is no less than 3 and no greater than 6; and a ratio of curvature of the outer fillet to the outer radius thickness is no less than 4 and no greater than 8;

wherein the side of the diaphragm facing away from the first end of the cylinder forms a taper angle from a plane perpendicular to the axis of no less than 0 degrees and no greater than 15 degrees;

wherein the side of the diaphragm facing the first end of the cylinder forms a taper angle from a plane perpendicular to the axis of no less than 0 degrees and no greater than 15 degrees;

a second actuator connected to the second end of the cylinder to move the cylinder and shroud in an axial direction against a restoring force of the diaphragm, the second actuator disposed about 180 degrees around the circumference of the cylinder from the first actuator;

a plurality of actuators connected to the second end of the cylinder to move the cylinder and shroud in an axial direction against a restoring force of the diaphragm, the first actuator and the plurality of actuators disposed substantially evenly around the circumference of the cylinder; and the shroud includes a spring hook extending in a radial direction from a radially outward extending edge of the shroud.

A method for dynamically controlling a distance between impeller blades and a surrounding compressor shroud in a radial compressor of a gas turbine engine can include measuring a compressor impeller inlet fluid temperature; measuring a compressor impeller exit fluid pressure; measuring a compressor impeller rotation rate; determining a desired distance between the impeller blades and the shroud based on conditions represented by the measured compressor impeller inlet fluid temperature, the measured compressor impeller exit fluid pressure, and the measured compressor impeller rotation rate; and commanding an actuator to move a diaphragm assembly attached to the shroud to an axial position corresponding to the desired distance.

The method of the preceding paragraph can optionally include providing feedback control by repeating the method of the preceding paragraph.

The invention claimed is:

1. A diaphragm assembly comprises:

a cylinder defining an axis, the cylinder including a first end; and a second end opposite the first end;

a circular flange coaxial with the cylinder and at a greater radial distance from the axis than the cylinder;

a diaphragm extending from the second end of the cylinder to the flange; and a first actuator connected to the second end of the cylinder to move the cylinder in an axial direction against a restoring force of the diaphragm.

2. The diaphragm assembly of claim 1, further comprising:

an inner fillet where the diaphragm extends from the second end of the cylinder, the inner fillet on a side of the diaphragm facing the first end of the cylinder; and an outer fillet where the diaphragm extends to the flange, the outer fillet on a side of the diaphragm facing away from the first end of the cylinder.

3. The diaphragm assembly of claim 2, further comprising an inner radius at a maximum radial extent of the inner fillet and an outer radius at a minimum radial extent of the outer fillet; a ratio of the outer radius to the inner radius is no less than 1.4 and no greater than 1.8.

4. The diaphragm assembly of claim 2, wherein the diaphragm tapers in thickness from an inner radius thickness at a maximum radial extent of the inner fillet to an outer radius thickness at a minimum radial extent of the outer fillet; the inner radius thickness being greater than the outer radius thickness.

5. The diaphragm assembly of claim 4, wherein a ratio of the inner radius thickness to the outer radius thickness is no less than 2 and no greater than 4.

6. The diaphragm assembly of claim 4, wherein a ratio of a radius of curvature of the inner fillet to the inner radius thickness is no less than 3 and no greater than 6; and a ratio of curvature of the outer fillet to the outer radius thickness is no less than 4 and no greater than 8.

7. The diaphragm assembly of claim 4, wherein the side of the diaphragm facing away from the first end of the cylinder forms a taper angle from a plane perpendicular to the axis of no less than 0 degrees and no greater than 15 degrees.

8. The diaphragm assembly of claim 7, wherein the side of the diaphragm facing the first end of the cylinder forms a taper angle from a plane perpendicular to the axis of no less than 0 degrees and no greater than 15 degrees.

9. A radial compressor comprising:

an impeller rotatable about an axis, the impeller including a frustoconical hub and a plurality of impeller blades extending radially from the hub;

a frustoconical shroud coaxial with the impeller and spaced a distance from the impeller blades to form a fluid flow path between the hub and the shroud;

a diaphragm assembly including:

a cylinder coaxial with and radially outward from a portion of the shroud, the cylinder having a first end connected to the shroud and a second end opposite the first end;

a circular flange coaxial with the cylinder and at a greater radial distance from the axis than the cylinder; and a diaphragm extending from the second end of the cylinder to the flange; and a first actuator connected to the second end of the cylinder to move the cylinder and shroud in an axial direction against a restoring force of the diaphragm and change the distance between the shroud and the impeller blades.

10. The radial compressor of claim 9, wherein the diaphragm assembly further includes:

an inner fillet where the diaphragm extends from the second end of the cylinder, the inner fillet on a side of the diaphragm facing the first end of the cylinder; and an outer fillet where the diaphragm extends to the outer flange, the outer fillet on a side of the diaphragm facing away from the first end of the cylinder.

11. The radial compressor of claim 10, wherein the diaphragm tapers in thickness from an inner radius thickness at a maximum radial extent of the inner fillet to an outer radius thickness at a minimum radial extent of the outer fillet; the inner radius thickness being greater than the outer radius thickness.

12. The radial compressor of claim 11, wherein a ratio of the inner radius thickness to the outer radius thickness is no less than 2 and no greater than 4.

13. The radial compressor of claim 11, wherein a ratio of a radius of curvature of the inner fillet to the inner radius thickness is no less than 3 and no greater than 6; and a ratio of curvature of the outer fillet to the outer radius thickness is no less than 4 and no greater than 8.

14. The radial compressor of claim 11, wherein the side of the diaphragm facing away from the first end of the cylinder forms a taper angle from a plane perpendicular to the axis of no less than 0 degrees and no greater than 15 degrees.

15. The radial compressor of claim 14, wherein the side of the diaphragm facing the first end of the cylinder forms a taper angle from a plane perpendicular to the axis of no less than 0 degrees and no greater than 15 degrees.

16. The radial compressor of claim 10, further comprising a second actuator connected to the second end of the cylinder to move the cylinder and shroud in an axial direction against a restoring force of the diaphragm, the second actuator disposed about 180 degrees around the circumference of the cylinder from the first actuator.

17. The radial compressor of claim 10, further comprising a plurality of actuators connected to the second end of the cylinder to move the cylinder and shroud in an axial direction against a restoring force of the diaphragm, the first actuator and the plurality of actuators disposed substantially evenly around the circumference of the cylinder.

18. The radial compressor of claim 10, wherein the shroud includes a spring hook extending in a radial direction from a radially outward extending edge of the shroud.

19. A method for dynamically controlling a distance between impeller blades and a surrounding compressor shroud in a radial compressor of a gas turbine engine; the method comprising:

measuring a compressor impeller inlet fluid temperature;

measuring a compressor impeller exit fluid pressure;

measuring a compressor impeller rotation rate;

determining a desired distance between the impeller blades and the shroud based on conditions represented by the measured compressor impeller inlet fluid temperature, the measured compressor impeller exit fluid pressure, and the measured compressor impeller rotation rate; and commanding an actuator to move a diaphragm assembly attached to the shroud to an axial position corresponding to the desired distance.

20. The method of claim 19, further comprising providing feedback control by repeating the method of claim 19.

* * * * *